US009145786B2

(12) United States Patent
Wang

(10) Patent No.: US 9,145,786 B2
(45) Date of Patent: Sep. 29, 2015

(54) METHOD AND APPARATUS FOR TURBINE CLEARANCE FLOW REDUCTION

(75) Inventor: Yu Wang, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 611 days.

(21) Appl. No.: 13/448,861

(22) Filed: Apr. 17, 2012

(65) Prior Publication Data

US 2013/0272839 A1 Oct. 17, 2013

(51) Int. Cl.
*F01D 11/04* (2006.01)
*F01D 11/10* (2006.01)

(52) U.S. Cl.
CPC ..... *F01D 11/10* (2013.01); *F01D 11/04* (2013.01)

(58) Field of Classification Search
CPC ..... F01D 11/10
USPC ..... 415/110, 116, 173.1
See application file for complete search history.

(56) References Cited

U.S. PATENT DOCUMENTS

| | | | | |
|---|---|---|---|---|
| 2,963,268 | A * | 12/1960 | Smile et al. | 415/110 |
| 3,597,102 | A * | 8/1971 | Unsworth et al. | 415/112 |
| 3,887,299 | A | 6/1975 | Profant | |
| 4,084,825 | A | 4/1978 | Ludwig | |
| 4,311,431 | A * | 1/1982 | Barbeau | 415/173.6 |
| 4,377,371 | A | 3/1983 | Wisander et al. | |
| 4,430,360 | A | 2/1984 | Bill et al. | |
| 4,436,311 | A | 3/1984 | Brandon | |
| 4,732,531 | A * | 3/1988 | Minoda et al. | 415/115 |
| 4,820,119 | A | 4/1989 | Joyce | |
| 5,282,718 | A | 2/1994 | Koff et al. | |
| 5,735,667 | A | 4/1998 | Sanders et al. | |
| 5,797,723 | A | 8/1998 | Frost et al. | |
| 5,810,365 | A | 9/1998 | Brandon et al. | |
| 6,152,685 | A | 11/2000 | Hagi | |
| 6,162,014 | A | 12/2000 | Bagepalli et al. | |
| 6,189,891 | B1 | 2/2001 | Tomita et al. | |

(Continued)

FOREIGN PATENT DOCUMENTS

| | | |
|---|---|---|
| DE | 102009025835 A1 | 12/2009 |
| EP | 1010864 | 6/2000 |

(Continued)

OTHER PUBLICATIONS

EP Search Report and Written Opinion issued Apr. 10, 2014 in connection with corresponding EP Patent Application No. 13163274.7.

*Primary Examiner* — Ninh H Nguyen
(74) *Attorney, Agent, or Firm* — Ernest G. Cusick; Frank A. Landgraff

(57) ABSTRACT

A method for reducing clearance flow in a channel between a bucket and an enclosure of a turbine. The method includes separating a single flow in the channel into a first flow and a second flow and directing the second flow radially inward toward the bucket so that the second flow rejoins with the first flow to increase total flow onto the bucket. A turbine includes an inner casing, a rotatable shaft positioned axially within the inner casing, a plurality of buckets connected to the shaft, a first tooth projecting radially inward from and connected to the inner casing, wherein the first tooth and at least one bucket form a first fluidic channel therebetween and a second tooth connected to and in parallel with the first tooth form a radial fluidic channel. The axial fluidic channel is in communication with the radial fluidic channel to form a second fluidic channel.

18 Claims, 6 Drawing Sheets

(56) References Cited

U.S. PATENT DOCUMENTS

| | | | | |
|---|---|---|---|---|
| 6,220,814 | B1 | 4/2001 | Brushwood et al. | |
| 6,220,815 | B1 | 4/2001 | Rainous et al. | |
| 6,261,063 | B1 | 7/2001 | Chikami et al. | |
| 6,422,022 | B2 | 7/2002 | Gorman et al. | |
| 6,485,025 | B1 | 11/2002 | Hammersley et al. | |
| 6,547,522 | B2 | 4/2003 | Turnquist et al. | |
| 6,652,227 | B2 | 11/2003 | Fried | |
| 6,883,807 | B2 | 4/2005 | Smed | |
| 6,926,928 | B2 | 8/2005 | Ackerman et al. | |
| 6,946,208 | B2 | 9/2005 | Subramanian et al. | |
| 7,238,001 | B2 * | 7/2007 | Rushton | 415/110 |
| 7,364,801 | B1 | 4/2008 | Hazel et al. | |
| 7,527,469 | B2 | 5/2009 | Zborovsky et al. | |
| 7,708,520 | B2 | 5/2010 | Paolillo et al. | |
| 7,784,264 | B2 | 8/2010 | Weaver et al. | |
| 7,797,948 | B2 | 9/2010 | Weaver et al. | |
| 8,052,375 | B2 | 11/2011 | Turnquist et al. | |
| 2004/0051254 | A1 | 3/2004 | Smed | |
| 2006/0127242 | A1 | 6/2006 | Martin et al. | |
| 2006/0277911 | A1 | 12/2006 | Rhodes et al. | |
| 2007/0128447 | A1 | 6/2007 | Hazel et al. | |
| 2009/0067997 | A1 | 3/2009 | Wu et al. | |
| 2009/0136345 | A1 | 5/2009 | Tholen et al. | |
| 2010/0307166 | A1 | 12/2010 | Woodcock et al. | |
| 2010/0330295 | A1 | 12/2010 | Hazel et al. | |
| 2010/0330393 | A1 | 12/2010 | Hazel et al. | |

FOREIGN PATENT DOCUMENTS

| | | | |
|---|---|---|---|
| EP | 1031702 | | 8/2000 |
| EP | 1270876 | | 1/2003 |
| EP | 1484426 | | 12/2004 |
| EP | 1930467 | | 6/2008 |
| EP | 1967700 | | 9/2008 |
| EP | 2065566 | | 6/2009 |
| EP | 2302169 | A2 | 3/2011 |
| JP | 1-132998 | | 5/1989 |
| JP | 05079446 | | 3/1993 |
| JP | 10-274003 | | 10/1998 |
| JP | 11-022412 | | 1/1999 |
| JP | 11-107705 | | 4/1999 |
| JP | 2005-002917 | | 1/2005 |
| JP | 2006-283595 | | 10/2006 |
| JP | 2009-221982 | | 10/2009 |
| JP | 2010-071466 | | 4/2010 |

* cited by examiner

METHOD AND APPARATUS FOR TURBINE CLEARANCE FLOW REDUCTION

TECHNICAL FIELD

Embodiments of the disclosure are directed to applications relating to steam turbines, and more particularly to an apparatus for lowering the margin stage bucket clearance flow.

BACKGROUND

Advances in steam turbine technology have generated improvements in efficiency and power generation capability. In closed systems, however, there are often losses at the margin stage buckets as steam flow seeps past the buckets between the bucket tip and the inner wall of the turbine enclosure. Reducing the physical clearance of the buckets only works to a certain extent, because certain minimum physical tolerances to permit the buckets to rotate freely must be respected. Accordingly, there is a need to reduce the effective clearance to reduce the losses of steam flow without reducing the physical clearance.

SUMMARY

The following presents a simplified summary that describes some aspects or embodiments of the subject disclosure. This summary is not an extensive overview of the disclosure. Indeed, additional or alternative embodiments of the subject disclosure may be available beyond those described in the summary.

The disclosure is directed to a method for reducing clearance flow in a channel between a bucket and an enclosure of a turbine, including the steps of separating a single flow in the channel into a first flow and a second flow and directing the second flow radially inward toward the bucket so that the second flow rejoins with the first flow in a way that lowers clearance flow and therefore increases the total flow through the bucket. The method may also include changing the direction of the second flow from substantially parallel to the first flow to become substantially perpendicular to the first flow. The second flow may be directed radially inward by forming a flow channel between a first tooth and a second tooth, the second tooth being positioned in parallel to the first tooth and wherein the first tooth and second tooth are connected to each other by ribs. The flow channel may form a ninety degree angle or at an angle pointing to the incoming direction of the first flow. Additionally, the second flow may be captured from flow through a clearance between a tip of a nozzle located upstream from the bucket and the enclosure of the turbine.

The disclosure is also directed to a method for reducing clearance flow in a channel between a bucket and an enclosure of a turbine, the method including the steps of generating a first flow and a second flow and directing the second flow radially inward toward the bucket so that the second flow joins with the first flow in a way that lowers the clearance flow and therefore increases overall flow to the bucket. The second flow may be introduced into the enclosure from an external source or captured from holes or slots through nozzle mountings (connectors) located upstream of the bucket, which are further connected to a circumferential channel. The direction of the second flow may be changed from substantially parallel to the first flow to become substantially perpendicular to the first flow.

The disclosure is also directed to an inner casing of a turbine having a bucket wherein the inner casing has an inner wall and an outer wall, the inner casing including a first tooth projecting radially inward from and connected to the inner wall, wherein the first tooth and the bucket form a first fluidic channel therebetween and a second tooth connected to and in parallel with the first tooth, wherein the second tooth and the inner wall form an axial fluidic channel therebetween and wherein the first tooth and the second tooth form a radial fluid channel therebetween and wherein the axial fluidic channel is in fluid communication with the radial fluidic channel to form a second fluidic channel. The first fluidic channel and second fluidic channel may be combined and the first channel may form substantially a ninety degree angle with respect to the second channel. Moreover, the inner wall and a stator may form a channel therebetween and wherein the second channel is formed upstream from the stator.

The disclosure is also directed to a turbine including an inner casing having an inner wall, a rotatable shaft positioned axially within the inner casing; a plurality of buckets connected to the shaft, a first tooth projecting radially inward from and connected to the inner wall, wherein the first tooth and at least one bucket form a first fluidic channel therebetween, and a second tooth connected to and in parallel with the first tooth, wherein the second tooth and the inner wall form an axial fluidic channel therebetween and wherein the first tooth and the second tooth form a radial fluid channel therebetween and wherein the axial fluidic channel is in fluid communication with the radial fluidic channel to form a second fluidic channel. The turbine may further include a stator within the inner casing wherein the axial fluidic channel is first formed between the stator and the inner wall.

BRIEF DESCRIPTION OF THE DRAWINGS

The following description is better understood when read in conjunction with the appended drawings.

DETAILED DESCRIPTION OF ILLUSTRATIVE EMBODIMENTS

Reference will now be made in detail to the various embodiments of the invention, one or more examples of which are illustrated in the figures. Each example is provided by way of explanation of the embodiment and is not meant as a limitation thereof. For example, features illustrated as part of one embodiment may be incorporated with respect to other embodiments. It is intended that any such modifications and variations are included herewith.

Figure 1:
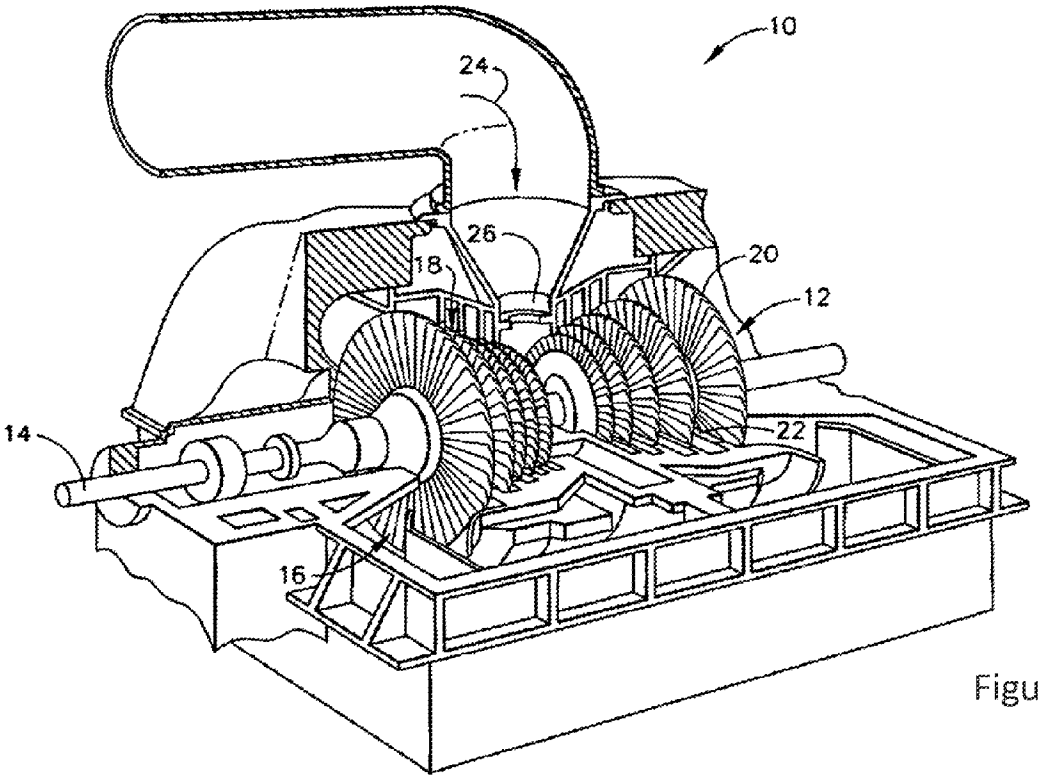
FIG. 1 is a schematic illustration of a turbine in accordance with an embodiment.

FIG. 1 is a perspective partial cut away view of a steam turbine 10 including a rotor 12 that includes a shaft 14 and a low-pressure (LP) turbine 16. LP turbine 16 includes a plurality of axially spaced rotor wheels 18. A plurality of buckets 20 are mechanically coupled to each rotor wheel 18. More specifically, buckets 20 are arranged in rows that extend circumferentially around shaft 14 and are axially positioned around each rotor wheel 18. A plurality of stationary nozzles 22 extend circumferentially around shaft 14 and are axially positioned between adjacent rows of buckets 20. Nozzles 22 cooperate with buckets 20 to form a turbine stage and to define a portion of a steam flow path through turbine 10.

In operation, steam 24 enters an inlet 26 of turbine 10 and is channeled through nozzles 22. Nozzles 22 direct steam 24 downstream against buckets 20. Steam 24 passes through the remaining stages imparting a force on buckets 20 causing rotor 12 to rotate. At least one end of turbine 10 may extend axially away from rotor 12 and may be attached to a load or machinery (not shown), such as, but not limited to, a generator and/or another turbine. Accordingly, a large steam turbine unit may actually include several turbines that are co-axially coupled to the same shaft 14. Such a unit may, for example, include a high-pressure turbine coupled to an intermediate-pressure turbine, which is coupled to a low-pressure turbine. It is understood that the configuration described above is a sample configuration of a steam turbine 10 and other configurations known to those skilled in the art are possible.

Figure 2:
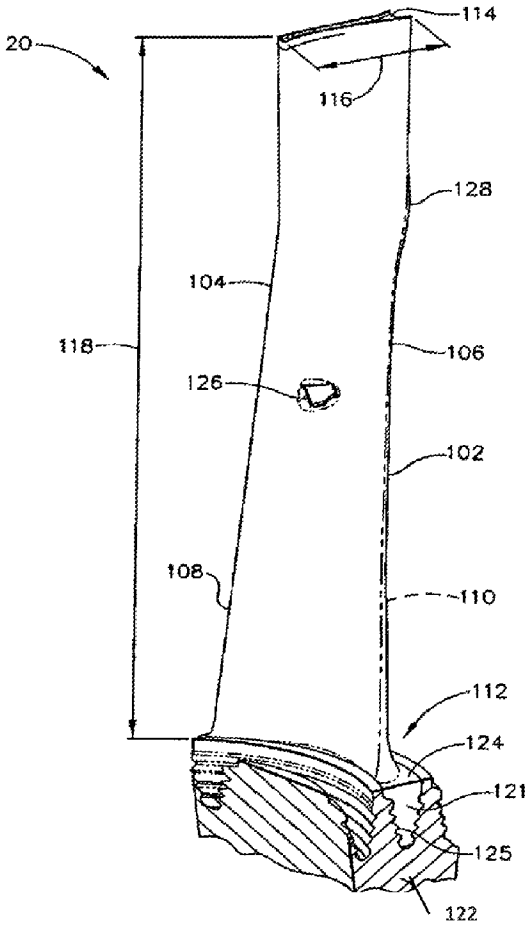
FIG. 2 is a schematic illustration of a side view of a turbine in accordance with an embodiment.

FIG. 2 is a perspective view of a turbine bucket 20 that may be used with turbine 10. Bucket 20 includes a blade portion 102 that includes a trailing edge 104 and a leading edge 106, wherein steam flows generally from leading edge 106 to trailing edge 104. Bucket 20 also includes a first concave sidewall 108 and a second convex sidewall 110. First sidewall 108 and second sidewall 110 are connected axially at trailing edge 104 and leading edge 106, and extend radially between a rotor blade root 112 and a rotor blade tip 114. A blade chord distance 116 is a distance measured from trailing edge 104 to leading edge 106 at any point along a radial length 118 of blade 102. In an embodiment, radial length 118 may be approximately fifty-two inches, although it will be understood that radial length 118 may vary depending on the desired application. Root 112 includes a dovetail 121 used for coupling bucket 20 to a rotor disc 122 along shaft 14, and a blade platform 124 that determines a portion of a flow path through each bucket 20. In an embodiment, dovetail 121 is a curved axial entry dovetail that engages a mating slot 125 defined in the rotor disc 122. However, it will be understood that other embodiments are possible, including a straight axial entry dovetail, angled-axial entry dovetail, or any other suitable type of dovetail configuration.

In accordance with an embodiment, first and second sidewalls 108 and 110 each include a mid-blade connection point 126 positioned between blade root 112 and blade tip 114 and used to couple adjacent buckets 20 together. The mid-blade connection may facilitate improving a vibratory response of buckets 20 in a mid-region between root 112 and tip 114. The mid-blade connection point may also be referred to as the mid-span or part-span shroud. The part-span shroud can be located at about 45% to about 65% of the radial length 118, as measured from the blade platform 124.

Figure 3:
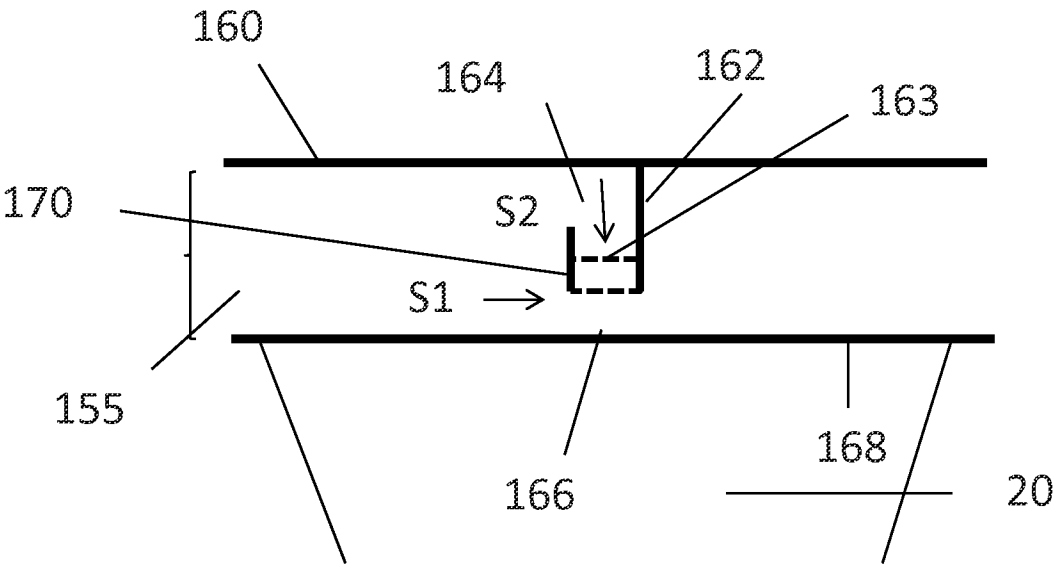
FIG. 3 is an illustration of an embodiment of the disclosure showing a channel between a turbine bucket tip and an inner casing of the turbine.

With reference to FIG. 3, there is shown an embodiment of the disclosure. The margin stage bucket clearance flow is lowered through the introduction of a radially inward flow and thereby reduces the effective clearance size. Bucket 20 has a tip cover 168 attached thereto. The tip cover may be individual across a single bucket 20 or may be integrated across the top of multiple buckets. The tip cover 168 and the inside of inner casing 160 form a channel 155 delineated by bracket through which steam may flow. Attached to the inner casing 160 is a tooth 162 projecting generally perpendicular into the channel 155 towards the tip cover 168. The tooth 162 may be made of any suitable type of metal or other material and may be of similar material to the inner casing 160. A second tooth 170 may be inserted in the channel 155 and connected to the tooth 162 by a rib 163. The second tooth 170 may be placed in such a manner so that there is a vertical channel 164 formed between the first tooth 162 and the second tooth 170. In connecting the first tooth 162 and the second tooth 170, rib 163 is sufficient to secure the second tooth 170 while at the same time allowing for steam to flow through the vertical channel 164. The steam flow through the vertical channel 164 is designated as S2. A second channel 166 is formed within channel 155 in the space between the structure involving the first tooth 162, the second tooth 170, and the rib 163 and the top of the bucket cover 168. That second channel 166 also permits a steam flow therethrough wherein the flow entering into the second channel 166 is designated as S1. Second tooth 170 may also be mounted to inner casing 160. The first tooth 162 and second tooth 170 are exemplary only and there may be other designs for the vertical channel 164 which fall within the scope of this disclosure.

Figure 4:
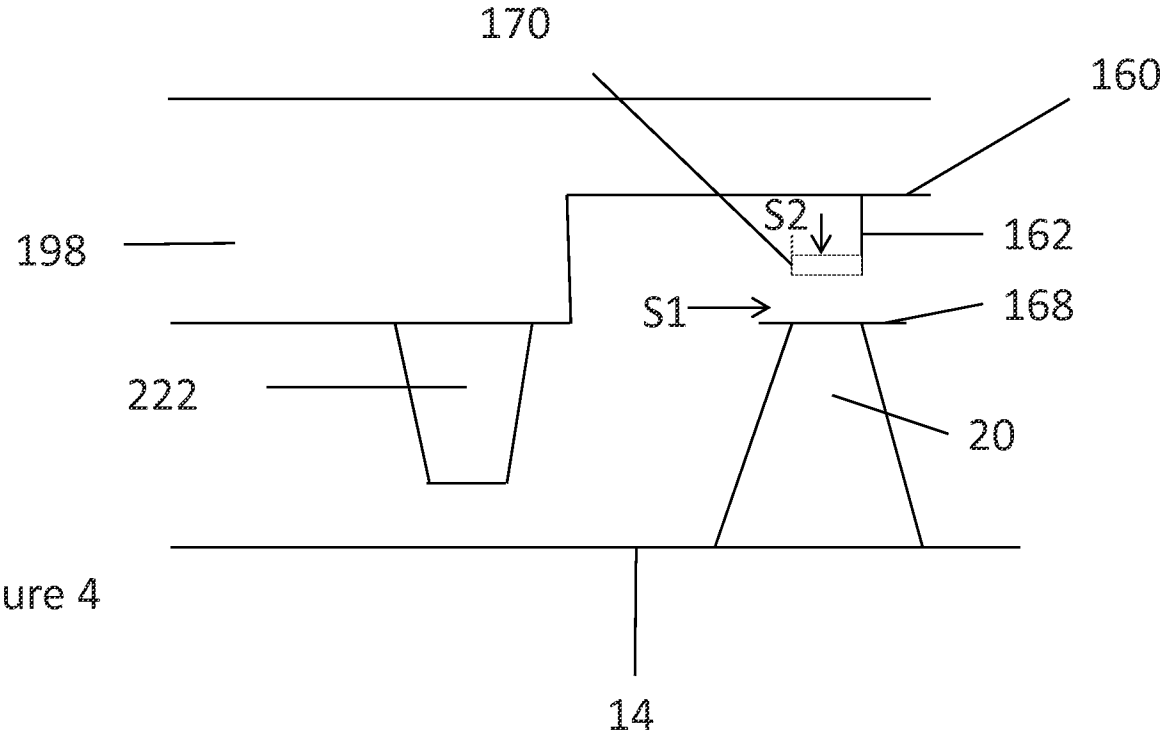
FIG. 4 is an illustration of an embodiment of the disclosure showing the channel of FIG. 3 and including an inlet nozzle.

FIG. 4 illustrates the embodiment of FIG. 3 with additional features added. For example, the base of bucket 20 is shown connected to shaft 14. Additionally, nozzle 222 is shown as connected to the interior of inner casing 160 through a nozzle connector 198. In operation of a steam turbine 10, steam is injected into the turbine 10 through nozzle 222 which provides the energy to turn bucket 20 and shaft 14.

At the end of the bucket 20 in a margin stage, for example, the last stage of the low pressure section of turbine 10, there is room for a steam flow designated as S1. That steam flow S1 is generally called leakage flow, and driven by the pressure difference across the bucket through the physical open space between the tip cover and inner casing. The combination of second tooth 170 connected to tooth 162 through rib 163 creates a radial fluidic jet which forms a second steam path S2. As S2 flows out of the vertical channel 164 and turns downstream, the S2 steam experiences a pressure increase because of the turning of the flow, thereby squeezing the S1 stream. That squeezing of the S1 stream has the technical effect of reducing the overall clearance flow through the space between the bucket tip cover 168 and the inner casing 160. The S2 stream is illustrated as being redirected at an angle substantially perpendicular to the S1 stream. Alternatively, the S2 stream may be redirected such that the angle between the convergence of the S1 flow and the S2 flow is greater than a ninety degree angle, meaning that the S2 flow may be redirected at an angle pointing to the incoming direction of the first flow.

In accordance with the example embodiment of FIG. 4 and based on simulated experimentation using practical flow conditions, the clearance flow may be reduced by 8%.

Figure 5:
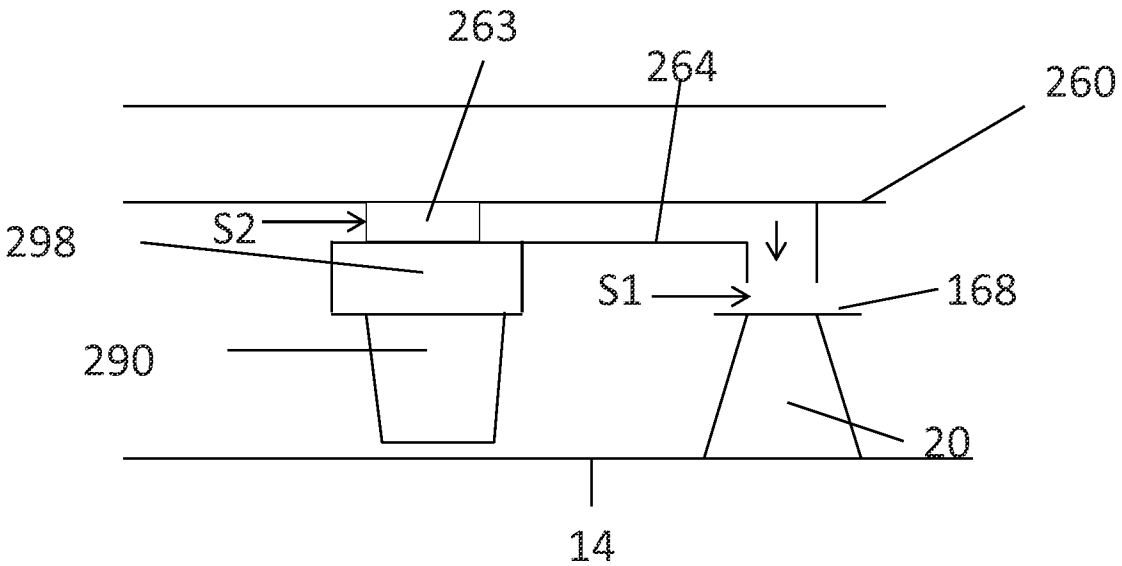
FIG. 5 is an illustration of an embodiment in which steam flows in a channel defined by the holes or slots through nozzle mountings and by the space between a nozzle extension and an inner casing of the turbine.

FIG. 5 shows an alternative embodiment of the disclosure. A full stage consisting of nozzle 290 having nozzle tip 298 and bucket 20 is shown where S2 is introduced from upstream of the nozzle 290. The S2 flow channel is formed in such a way that holes/slots are created through the nozzle mountings (or connectors) 263 and then connected to the open space between inner casing 260 and nozzle extension 264, which bends radially inward toward the tip 168 of bucket 20. Since the pressure upstream of the nozzle 290 is higher than the pressure at S1, S2 may further squeeze S1 as it turns where it meets S1 to reduce clearance flow. Simulations showed about a 26% reduction in clearance flow compared to a typical design that does not contain this embodiment of the disclosure.

Figure 6:
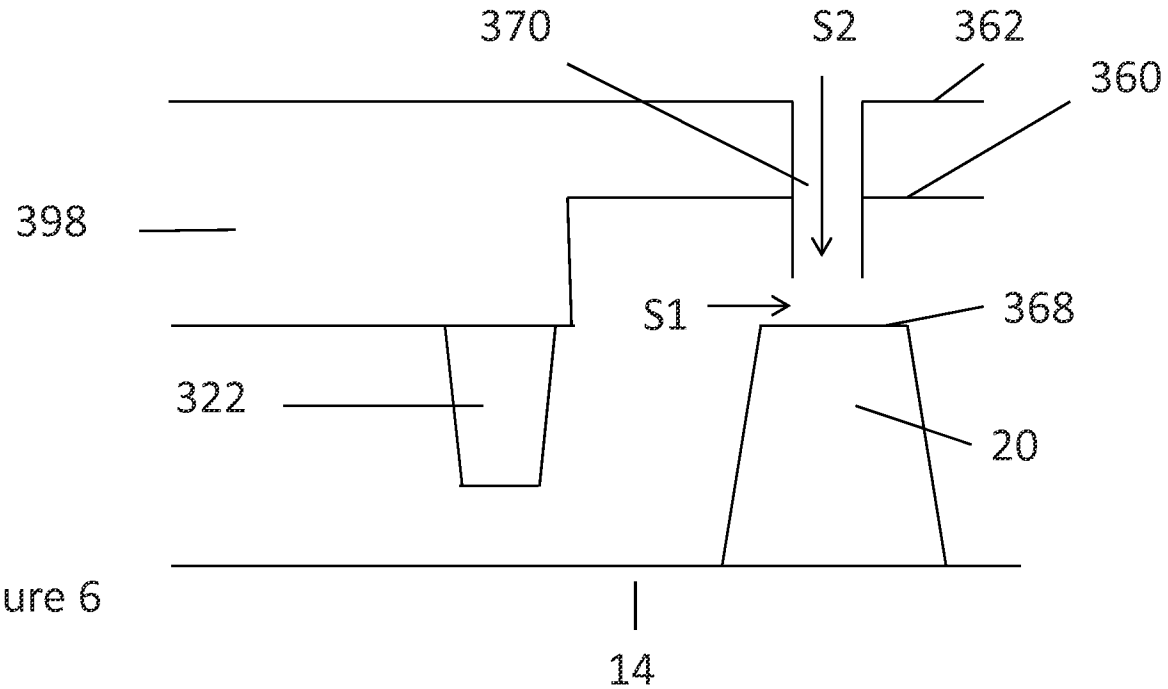
FIG. 6 is an illustration of an embodiment of the disclosure in which a second steam flow is introduced from an external source.

FIG. 6 illustrates an alternative embodiment of FIG. 4 wherein the source of steam flow S2 is external of the turbine 10 before being combined with steam flow S1. The base of bucket 20 is shown connected to shaft 14. Nozzle 322 is shown as connected to the interior of inner casing 160 through a nozzle connector 398. In operation of a steam turbine 10, steam is injected into the turbine 10 through nozzle 322 which provides the energy to turn bucket 20 and shaft 14.

At the end of the bucket 20 in a margin stage, for example, the last stage of the low pressure side of turbine 10, there is room for a steam flow designated as S1. Bucket 20 has a tip 368 over which the S1 flows. A second fluidic jet 370 is formed by a slot through the inner casing 360 with an extension protruding therefrom which forms a second steam path S2. The external steam path may be from any external source or may be reintroduced into the turbine 10 from another outlet. Steam path S2 through fluidic jet 370 exerts pressure radially inward onto steam flow S1 and the S2 pressure squeezes S1. This in turn reduces the ratio of flows through the channel at the tip 168 as compared to the bucket 20 and thereby reduces the clearance.

It should be understood that this invention may be applicable to the last stage of a steam turbine, but may also be applicable to the other stages as well. It should also be understood that the example clearance reductions are exemplary only and are in no way meant to be limiting. It also should be understood that other configurations which increase the flow onto the end stage bucket of a turbine in which the flow, either generated internally or externally, by redirecting flow radially inward are also considered to be within the scope and breadth of the disclosure. While the disclosure has been described with respect to steam turbines, other types of turbomachinery, turbine, compressor or pump may also be considered to be within the scope and breadth of the disclosure.

With respect to the various embodiments of the various figures, it is to be understood that other similar embodiments may be used or modifications and additions can be made to the described embodiments. This written description uses such examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Therefore, apparatuses, systems and methods for turbine clearance flow reduction should not be limited to any single embodiment, but rather should be construed in breadth and scope in accordance with the appended claims.

What is claimed:

1. A method for reducing clearance flow in a channel between a bucket and an enclosure of a turbine, comprising:

generating a first flow and a second flow;

directing the second flow radially inward toward the bucket so that the second flow joins with the first flow to reduce the clearance flow and thereby increase overall flow through the bucket, wherein the second flow is captured from a clearance between a tip of a nozzle located upstream from the bucket and an inner casing of the turbine.

2. The method of claim 1 wherein a single flow is separated into the first flow and a second flow.

3. The method of claim 2 wherein the direction of the second flow is changed from substantially parallel to the first flow to substantially perpendicular to the first flow.

4. The method of claim 2 wherein the direction of the second flow is changed from a direction substantially parallel to the first flow to a direction forming an angle greater than ninety degrees between the first flow and the second flow as measured at the convergence of the first flow and second flow.

5. The method of claim 2 wherein the second flow is directed radially inward by forming a flow channel between a first tooth and a second tooth, wherein the first tooth and second tooth are connected to each other by a rib.

6. The method of claim 5 wherein the flow channel forms an angle greater than or equal to ninety degrees with respect to the first flow.

7. The method of claim 5 wherein the second flow is captured from flow through a clearance between a bucket tip cover and an inner casing of the turbine.

8. The method of claim 1 wherein the second flow is introduced into the enclosure from an external source.

9. The method of claim 1 wherein the direction of the second flow is changed from substantially parallel to the first flow to become substantially perpendicular to the first flow.

10. The method of claim 1 wherein the direction of the second flow is changed from a direction substantially parallel to the first flow to a direction forming an angle greater than ninety degrees between the first flow and the second flow as measured at the convergence of the first flow and the second flow.

11. An inner casing of a turbine having a bucket wherein the inner casing has an inner wall and an outer wall comprising:

a first tooth projecting radially inward from and connected to the inner wall, wherein the first tooth and the bucket form a first fluidic channel therebetween;

a second tooth connected to the first tooth, wherein the second tooth and the inner wall form an axial fluidic channel therebetween and wherein the first tooth and the second tooth form a radial fluid channel therebetween and wherein the radial fluidic channel is in fluid communication with the first fluidic channel to form a second fluidic channel.

12. The inner casing of claim 11 wherein the first fluidic channel and the radial fluidic channel are combined in proximity to the bucket.

13. The inner casing of claim 11 wherein the first channel forms substantially a ninety degree angle with respect to the second channel.

14. The inner casing of claim 11 wherein the first channel forms an angle equal to or greater than ninety degrees with respect to the second channel.

15. The inner casing of claim 11 wherein the inner wall and a nozzle form a channel therebetween, and wherein the second channel is formed upstream from the nozzle.

16. A turbine comprising:

an inner casing having an inner wall;

a rotatable shaft positioned axially within the inner casing;

a plurality of buckets connected to the shaft, each of the buckets having a tip;

an axial fluidic channel formed between the inner casing and the tip of the buckets;

a radial fluidic channel in fluid communication with the axial fluidic channel wherein the radial fluidic channel forms an angle equal to or greater than ninety degrees with respect to the axial fluidic channel, wherein the axial fluidic channel is defined by at least one bucket tip and a first tooth projecting radially inward from and connected to the inner wall, and wherein a second fluidic channel is defined by a second tooth and the inner wall, and wherein the first tooth and the second tooth form the radial fluidic channel therebetween.

17. The turbine of claim 16 further comprising a nozzle within the inner casing wherein the axial fluidic channel is first formed between the nozzle and the inner wall.

18. The turbine of claim 16 wherein the radial fluidic channel projects radially through the inner casing and toward the tip of the at least one bucket.

* * * * *